US007579566B2

(12) United States Patent
Sloan et al.

(10) Patent No.: US 7,579,566 B2
(45) Date of Patent: Aug. 25, 2009

(54) WALLBOX DIMMER HAVING A SLIDING COVER PLATE

(75) Inventors: Greg Edward Sloan, Allentown, PA (US); Edward J. Blair, Lansdale, PA (US); Nicole R. Vigue, Bethlehem, PA (US); Richard David Samuels, Riegelsville, PA (US)

(73) Assignee: Lutron Electronics Co., Ltd., Coopersburg, PA (US)

( * ) Notice: Subject to any disclaimer, the term of this patent is extended or adjusted under 35 U.S.C. 154(b) by 154 days.

(21) Appl. No.: 11/750,662

(22) Filed: May 18, 2007

(65) Prior Publication Data

US 2007/0272535 A1 Nov. 29, 2007

Related U.S. Application Data

(60) Provisional application No. 60/808,309, filed on May 24, 2006.

(51) Int. Cl.
*H01H 9/00* (2006.01)

(52) U.S. Cl. ..... 200/331; 200/302.1; 200/302.2

(58) Field of Classification Search ..... 200/331, 200/329, 332, 332.1, 333, 547, 548, 549, 200/302.1; 174/66, 67
See application file for complete search history.

(56) References Cited

U.S. PATENT DOCUMENTS 1,569,864 A * 1/1926 Leppert ..... 200/295
3,723,692 A * 3/1973 Wilbrecht ..... 200/302.1
3,746,923 A 7/1973 Spira et al.
4,695,820 A 9/1987 D'Aleo et al.
4,742,188 A 5/1988 Buehler et al.
4,803,380 A 2/1989 Jacoby, Jr. et al.
4,833,277 A 5/1989 Jacoby, Jr. et al.
4,835,343 A 5/1989 Graef et al.
4,871,893 A * 10/1989 Slovak et al. ..... 200/16 R
4,924,349 A 5/1990 Buehler et al.

(Continued)

FOREIGN PATENT DOCUMENTS

DE 32 37 055 A1 4/1983

(Continued)

OTHER PUBLICATIONS

International Search Report mailed Nov. 27, 2007 in corresponding International Application No. PCT/US2007/012162.

*Primary Examiner*—Michael A Friedhofer
(74) *Attorney, Agent, or Firm*—Ostrolenk, Faber, Gerb & Soffen, LLP

(57) ABSTRACT

A faceplate structure for a load control device comprises a bezel, an operating knob extending through an elongated rectangular opening of the bezel, and a sliding cover plate disposed behind the bezel. The bezel defines side walls and is adapted to be fixed to the load control device. The elongated rectangular opening extends along a vertical axis of the bezel. The operating knob is operable to vertically move along the length of the elongated opening. The cover plate is slidably coupled to the side walls of the bezel. The shaft of the operating knob is coupled to the cover plate, such that the cover plate is vertically movable with respect to the bezel. The cover plate covers the rear of the opening in all positions to which the cover plate can be moved by the operating knob.

16 Claims, 10 Drawing Sheets

U.S. PATENT DOCUMENTS 4,939,383 A 7/1990 Tucker et al.
4,947,054 A * 8/1990 Flowers et al. ..... 307/125
5,191,971 A 3/1993 Hakkarainen et al.
5,998,747 A 12/1999 Kelso et al.
6,259,351 B1 * 7/2001 Radosavljevic et al. ..... 338/176
6,313,420 B1 * 11/2001 Ohashi ..... 200/302.1
6,459,250 B1 * 10/2002 Davis ..... 323/352
7,122,753 B1 * 10/2006 Davis ..... 200/331
7,416,310 B1 * 8/2008 Savicki, Jr. ..... 362/95
2006/0255662 A1 11/2006 Abel

FOREIGN PATENT DOCUMENTS

GB 2 419 741 A1 5/2006

* cited by examiner

WALLBOX DIMMER HAVING A SLIDING COVER PLATE

RELATED APPLICATIONS

This application claims priority from commonly-assigned U.S. Provisional Patent Application Ser. No. 60/808,309, filed May 24, 2006, entitled DESIGNER STYLE SLIDE DIMMER, the entire disclosure of which is hereby incorporated by reference.

BACKGROUND OF THE INVENTION

1. Field of the Invention

This invention relates to load control devices for electrical loads, such as lighting and motor loads, and more specifically, to a faceplate assembly for a wallbox dimmer having a slide control provided in an opening and a cover plate for covering the opening.

2. Description of the Related Art

Wallbox dimmers with slide controls are well known. For example, Lutron Electronics Co., Inc is the manufacturer of the Glyder® slide dimmer (e.g., the slider dimmer 10 shown in FIG. 1), which is adapted for use with a traditional-style faceplate 12. The slide dimmer 10 includes a slide potentiometer (not shown) having a potentiometer shaft 14 extends through a narrow slot 15 in a frame 16 and through a traditional-style rectangular opening 17 in the faceplate 12. A slider knob 18 is fastened to the free end of the potentiometer shaft 14 for moving the shaft vertically for adjustment of the amount of power being delivered to a connected lighting load. The narrow slot 15 in the frame 16 behind the faceplate 12 is always visible through the rectangular opening 17. Further, foreign material can enter the narrow slot 15 in the frame 16 and reach the interior of the slider dimmer 10.

Lutron Electronics Co., Inc. also manufactures the Skylark® designer-style slide dimmer (e.g., the slide dimmer 20 shown in FIG. 2), which is adapted for use with a designer-style faceplate 22. A bezel 26 has a large surface area and a narrow vertical slot 25 for receiving a potentiometer shaft (not shown) of a slider potentiometer (not shown) inside the dimmer 20. An on/off toggle button 29 may also be provided below the end of the narrow slot 25. A slider knob 28 is provided on the free end of the potentiometer shaft. The designer-style faceplate 22 fits over the bezel 26 with the bezel projecting through a rectangular opening 27 in the faceplate. Again, however, the narrow slot 25 in the bezel 26 is visible in all adjustment positions of the slider knob 28 on the potentiometer shaft and is open to debris and the like.

The problem of the visible narrow slot has been solved in the past by Lutron. FIG. 3 shows a prior art dimmer 30 sold by Lutron Electronics Co., Inc. under the name NOVA T STAR. The dimmer 30 comprises a very wide slider and integral knob 38. The slider and integral knob 38 are received in an opening 37 of a faceplate 32, which has dimensions that are unique to the NOVA T STAR dimmer 30. Since the faceplate 32 has a uniquely sized opening, the NOVA T STAR dimmer 30 is more expensive than the Glyder® dimmer 10 or the Skylark® dimmer 20. However, there is no narrow slot (i.e., the narrow slot 15 of FIG. 1 or the narrow slot 25 of FIG. 2) that provides access for external materials to enter the dimmer 30.

It is very desirable to provide a slide dimmer, which is affordable, is easily assembled, and provides that the narrow slot in the yoke is always covered (i.e., direct access to the potentiometer is prevented).

SUMMARY OF THE INVENTION

According to the present invention, a load control device comprises a bezel fixed to a front surface of the load control device and having a rectangular opening therein the bezel defining side walls; a flat cover plate disposed behind the bezel and slidably movable along a vertical axis with respect to the front surface of the load control device; and an operating knob having a shaft coupled to the cover plate and projecting through the opening of the bezel, the cover plate covering the rear of the opening in all positions to which the cover plate can be moved by the operating knob; further wherein the cover plate comprises a plurality of flexible fingers projecting into contact with the side walls of the bezel to hold the cover plate in position until moved by movement of the operating knob.

The present invention further provides a wallbox dimmer for controlling the amount of power delivered from an AC power source to an electrical load. The dimmer comprises an enclosure adapted to fit into an opening of an electrical wallbox; a yoke fixed to the enclosure and adapted to mount the dimmer to the electrical wallbox; an electrical control component mounted within the enclosure and having a vertically-movable thin elongated operating member extending out of an opening of the yoke and beyond a front surface of the yoke; a rectangular bezel having side walls defining a shallow cup and a front surface extending across one end of the cup, the opposite and open end of the cup being fixed to the front surface of the yoke, the front surface of the bezel having a rectangular opening in the center thereof; an operating knob having a shaft extending through the rectangular opening in the bezel and fixed to the free end of the operating member, the operating knob operable to vertically move across the length of the rectangular opening; and a generally flat cover plate slidably positioned immediately behind the rectangular opening in the bezel and captured in the interior of the cup against the side walls of the bezel, the cover plate comprising an opening through which the shaft of the operating knob extends, such that the cover plate is vertically moveable with the operating knob, the cover plate fully covering the rectangular opening over the full length of the vertical movement of the operating knob, whereby the opening of the yoke is covered by the cover plate in all vertical positions of the operating knob; further wherein the cover plate comprises a plurality of flexible fingers projecting into contact with the side walls of the bezel to hold the cover plate in position until moved by movement of the operating knob.

In addition, the present invention provides a faceplate structure for a load control device, the faceplate structure comprising a bezel adapted to be fixed to the load control device, the bezel defining side walls and having an elongated rectangular opening extending along a vertical axis of the bezel; an operating knob having a shaft extending through the elongated opening of the bezel and operable to vertically move along the length of the elongated opening; and a cover plate disposed behind the bezel and slidably coupled to the side walls of the bezel, the shaft of the operating knob coupled to the cover plate, such that the cover plate is vertically movable with respect to the bezel, the cover plate covering the rear of the opening in all positions to which the cover plate can be moved by the operating knob; further wherein the cover plate comprises a plurality of flexible fingers projecting into contact with the side walls of the bezel to hold the cover plate in position until moved by movement of the operating knob.

Other features and advantages of the present invention will become apparent from the following description of the invention that refers to the accompanying drawings.

DETAILED DESCRIPTION OF THE INVENTION

Figure 1:
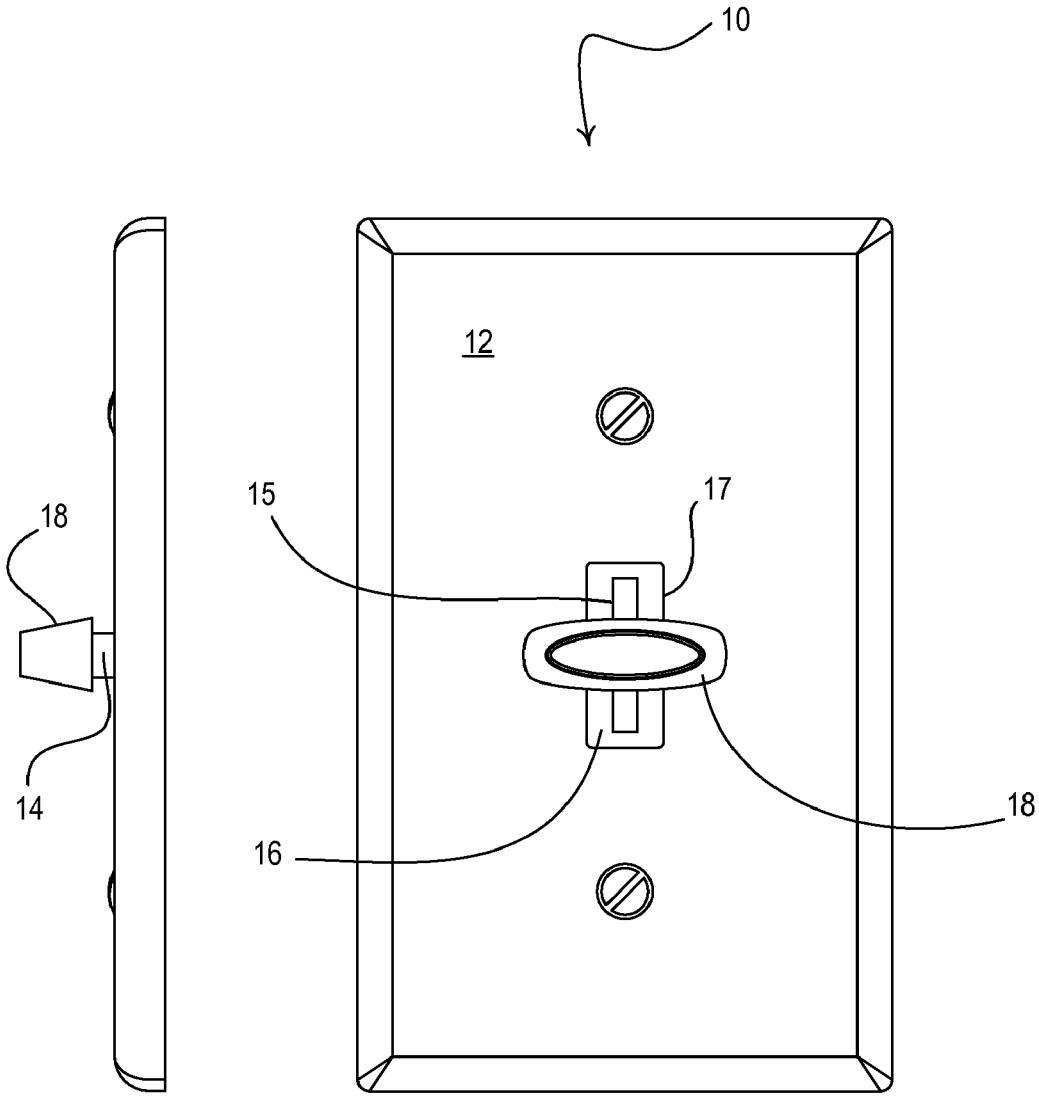
Fig. 1 Prior Art
FIG. 1 shows a front view and a right side view of a prior art Glyder® dimmer.
Figure 2:
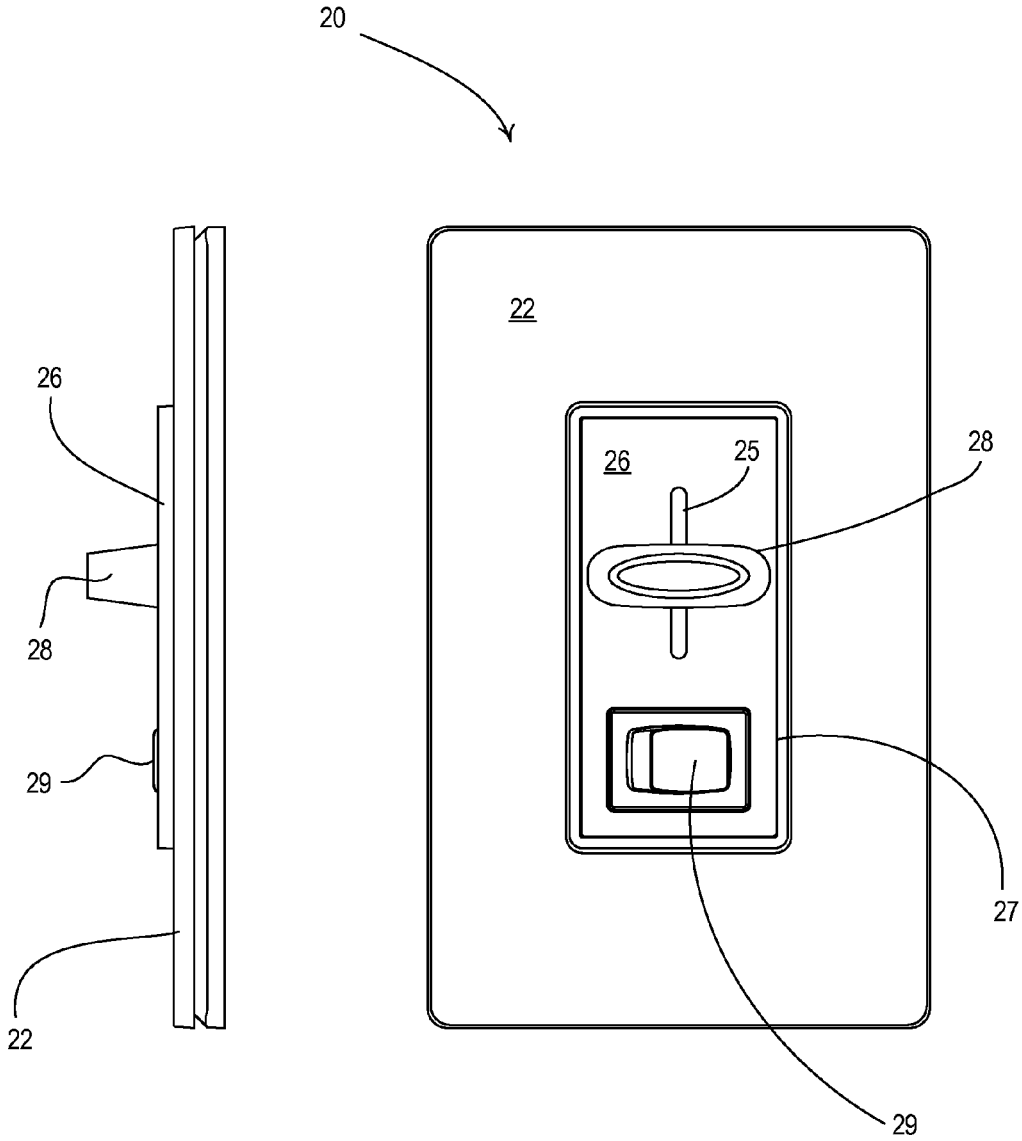
Fig. 2 Prior Art
FIG. 2 shows a front view and a right side view of a prior art Skylark® dimmer.
Figure 3:
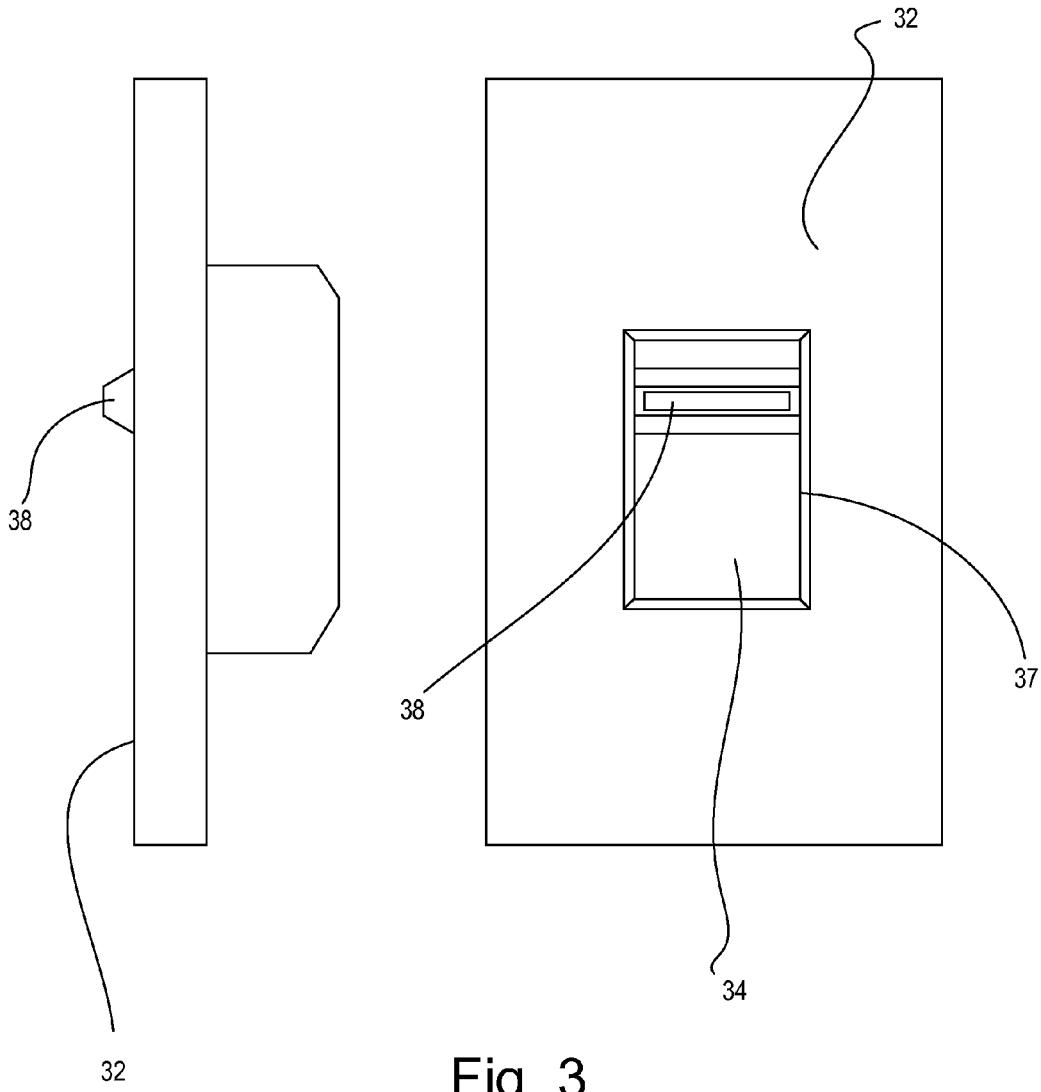
Fig. 3 Prior Art
FIG. 3 shows a front view and a right side view of a prior art NOVA® dimmer.
Figure 4:
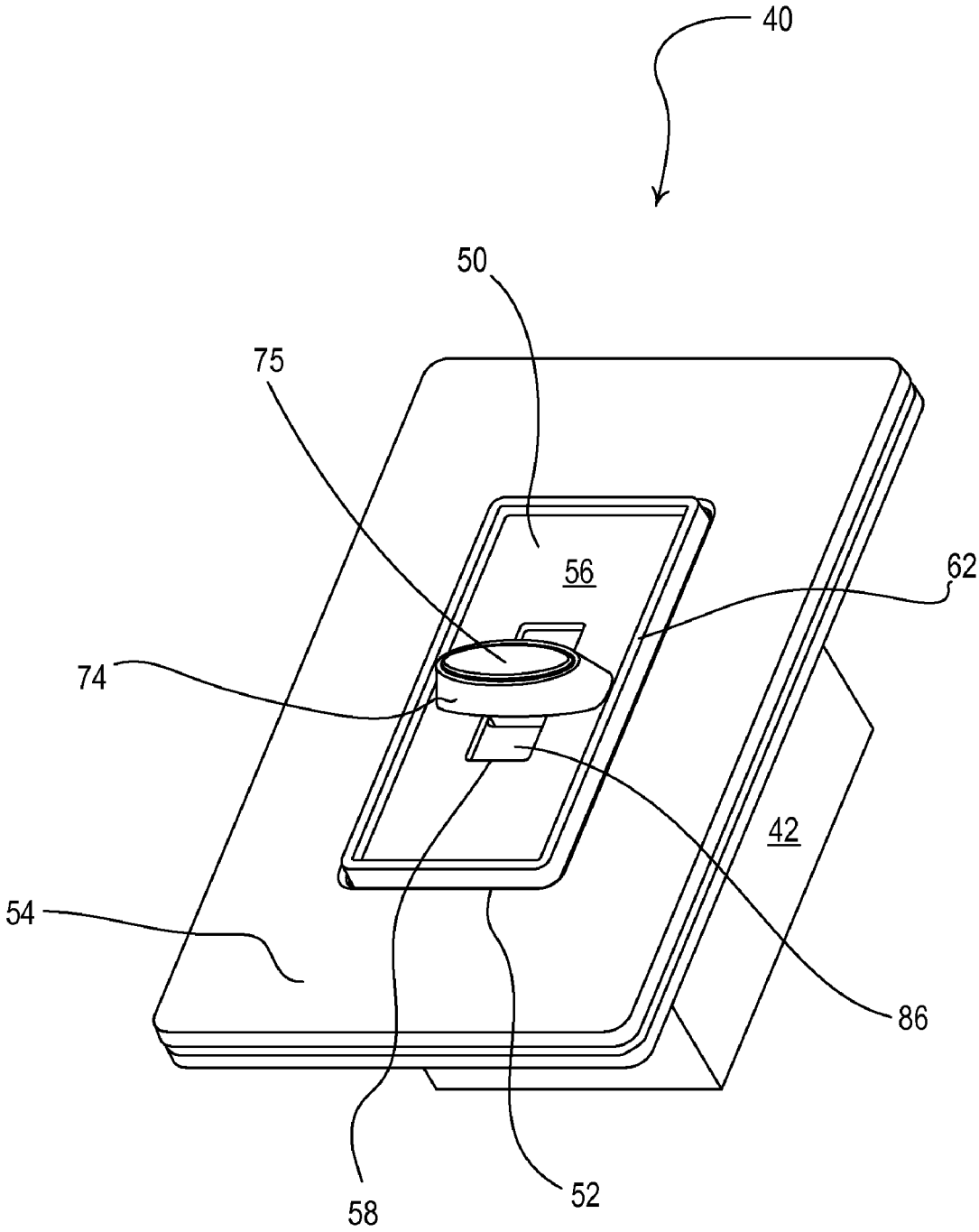
FIG. 4 is a perspective view of a dimmer having a faceplate assembly in accordance with the present invention
Figure 5:
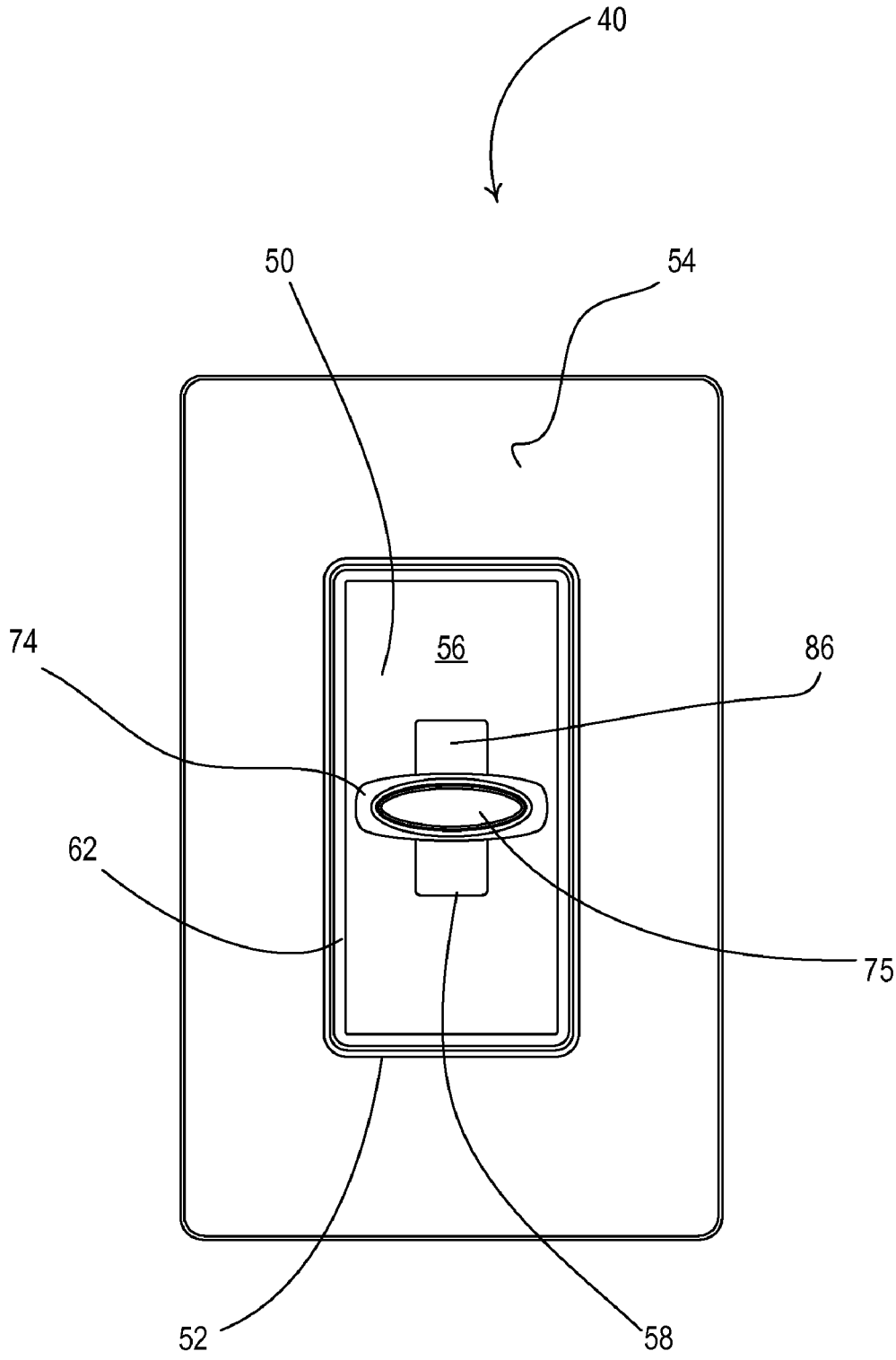
FIG. 5 is a front view of the dimmer of FIG. 4.
Figure 6:
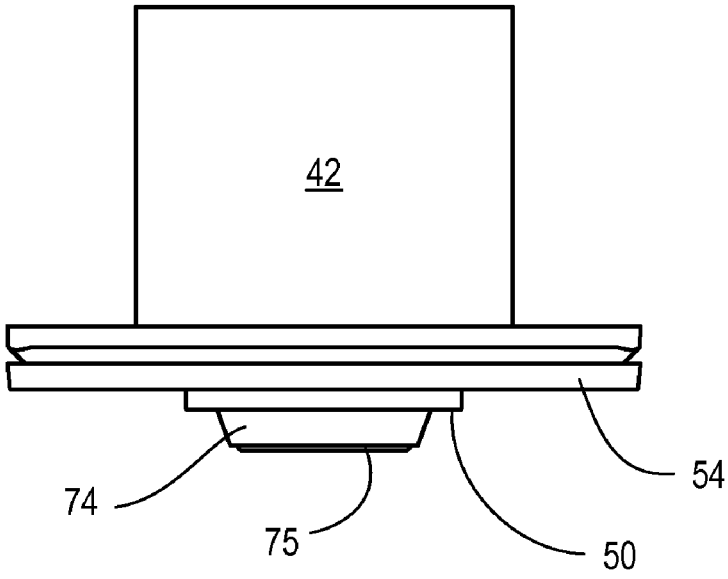
FIGS. 6 and 7 are top and bottom views respectively of the dimmer of FIG. 4.
Figure 7:
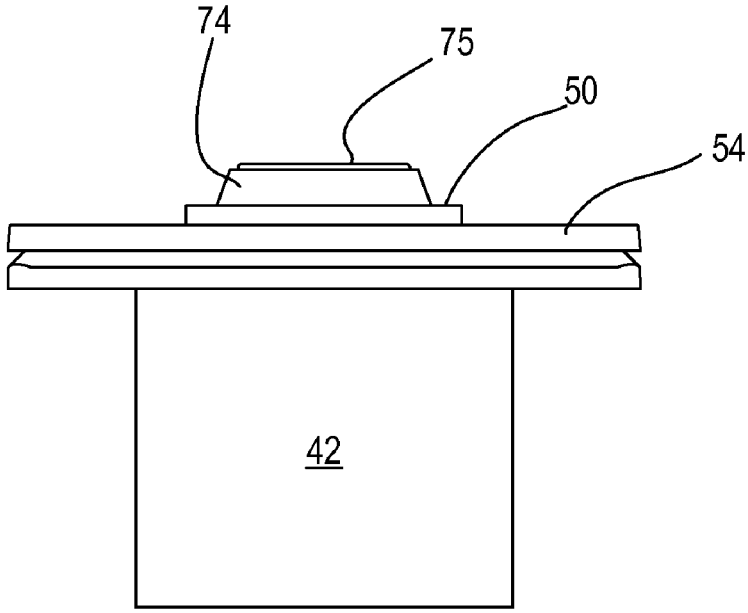
Figure 8:
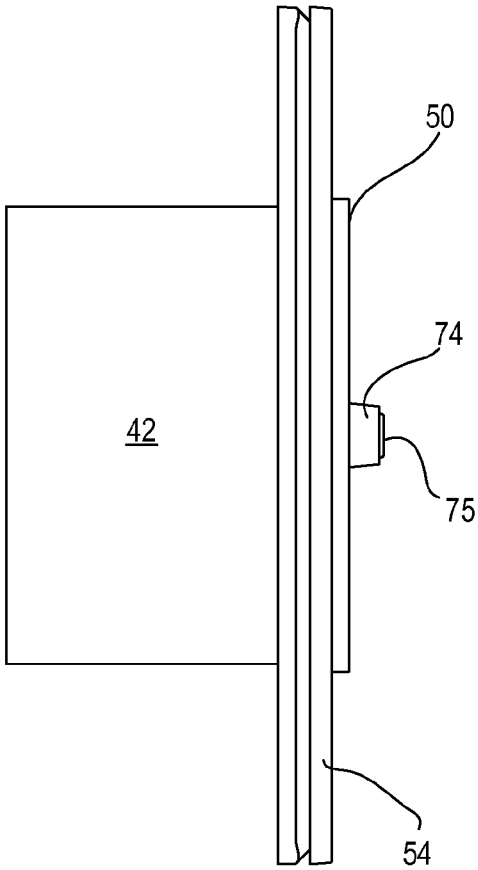
FIGS. 8 and 9 are left and right side views respectively of the dimmer of FIG. 4.
Figure 9:
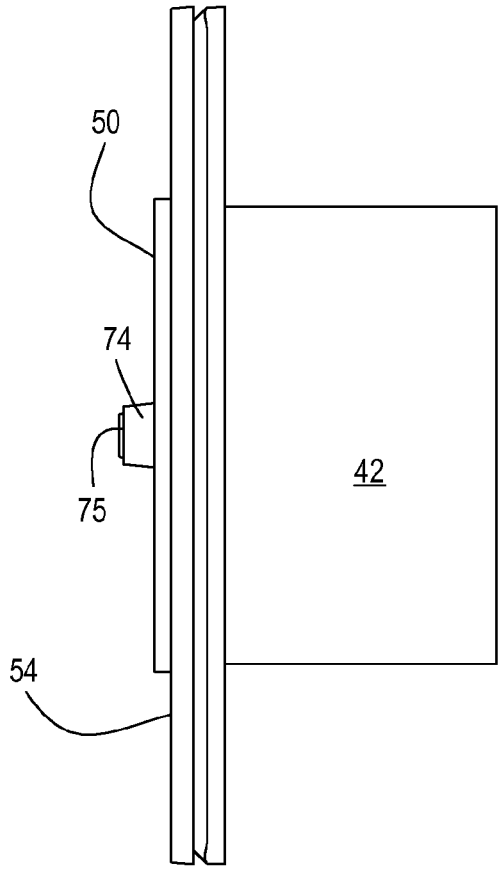

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

Figure 10:
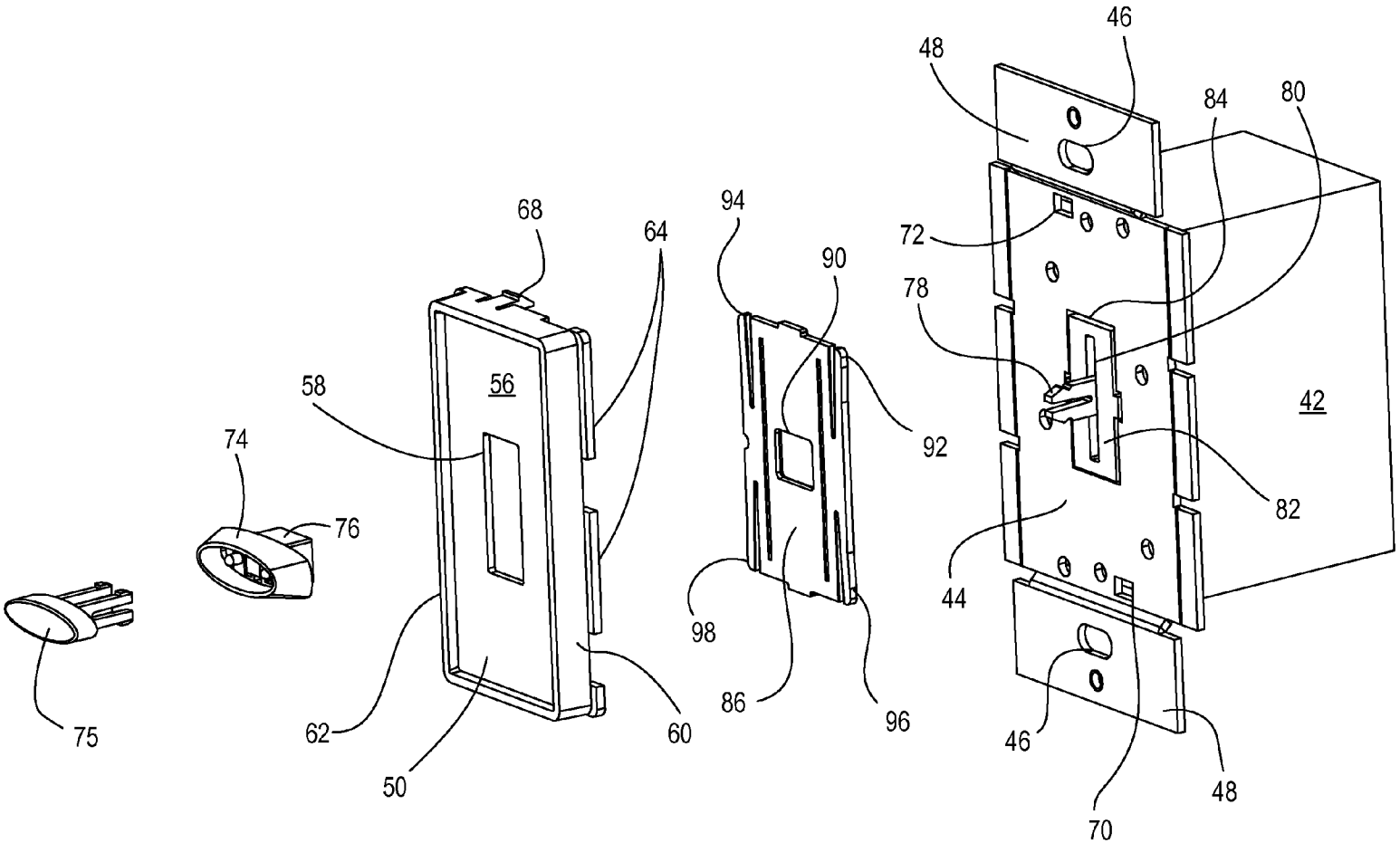
FIG. 10 is an exploded view of the dimmer of FIG. 4.
Figure 11:
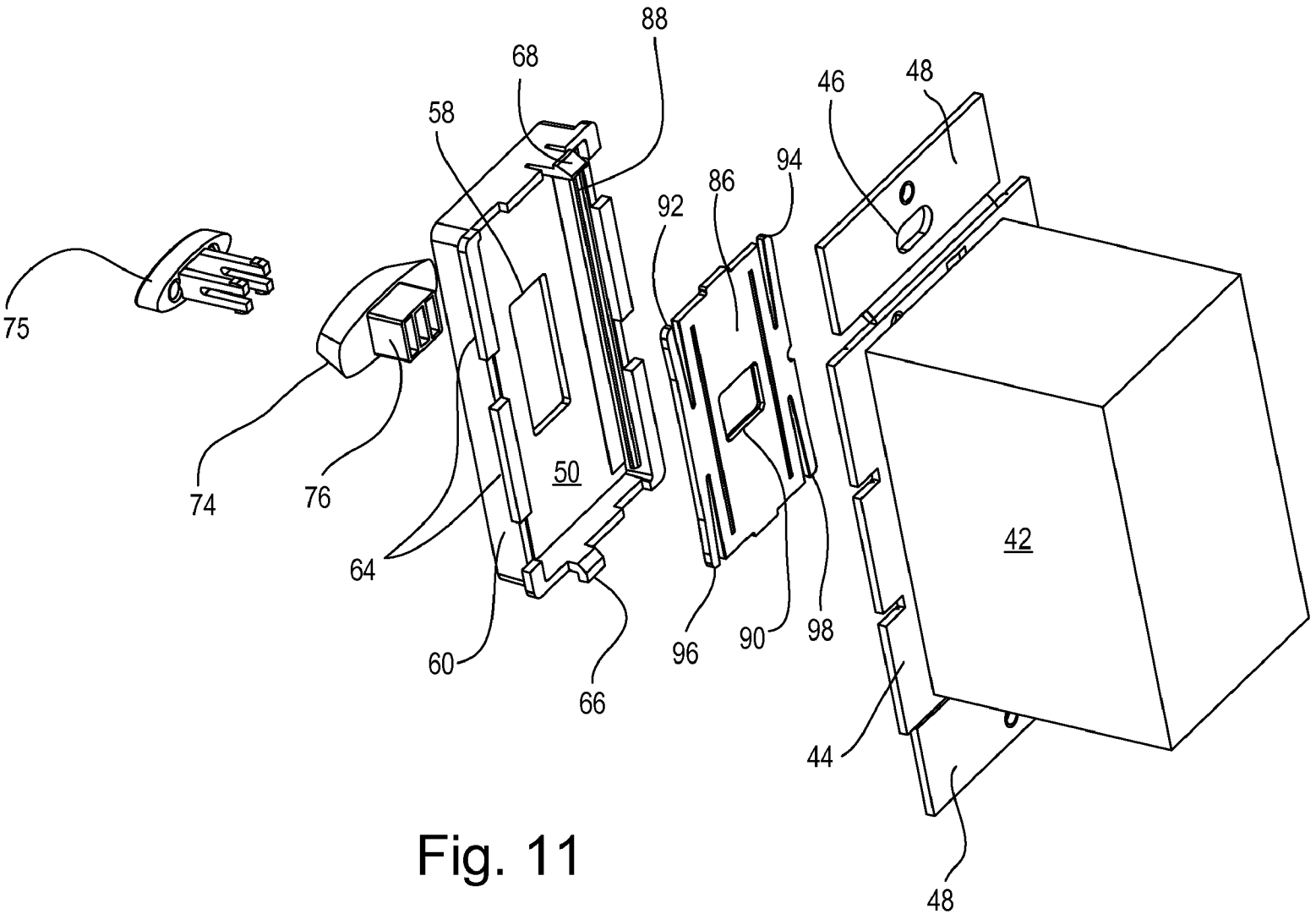
FIG. 11 is an exploded view of the dimmer of FIG. 4 as seen from a different angle.
Figure 14:
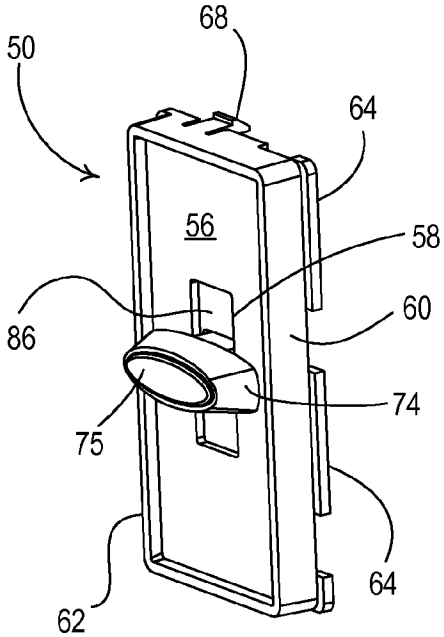
FIG. 14 is a rear perspective view of the faceplate assembly of FIGS. 12 and 13.

FIGS. 4-14 show a novel wallbox dimmer 40 according to the present invention. The dimmer 40 comprises a conventional enclosure 42, which fits into a standard electrical wallbox (not shown). The enclosure 42 houses the control circuitry (not shown) of the dimmer 40 and includes connection terminals (not shown) to external wiring, i.e., a source of AC power and a connected lighting load, as usual. A yoke 44 of the dimmer 40 allows for attachment of the dimmer 40 to the electrical wallbox in the usual manner, as by screws through openings 46 in connection flanges 48 (FIG. 10).

The dimmer 40 comprises a rectangular bezel 50 operable to be received in a faceplate opening 52 of a designer-style faceplate 54. The faceplate opening 52 of the designer-style faceplate 54 preferably has a length of 2.630" and a width of 1.310" (NEMA Standards Publication No. WD6, 2001, p. 5). Preferably, the bezel 50 projects through the faceplate opening 52. The bezel 50 has a front surface 56 and a rectangular opening 58 provided in the front surface. The bezel opening 58 is preferably the same size as an opening of a traditional-style faceplate, i.e., having a length of 0.925" and a width of 0.401" (NEMA Standards Publication No. WD6, 2001, p. 7).

The bezel 50 further comprises left and right side walls 60 defining a shallow cup. The front surface 56 is provided across one end of the cup and is surrounded at the periphery by a rim 62. The opposite and open end of the cup is adapted to be fixed to the front surface of the yoke 44. The bezel 50 comprises flanges 64 on the left and right sides to allow the bezel to be captured between the designer-style faceplate 54 and the yoke 44 of the dimmer 40. The bezel 50 comprises attachment posts, e.g., a clip projection 66 (i.e., a hook) and a snap projection 68, for fixed attachment to the yoke 44. The yoke 44 comprises a clip attachment opening 70 and a snap attachment opening 72 for receipt of the clip projection 66 and the snap projection 68 of the bezel 50, respectively. During attachment of the bezel 50 to the yoke 44, the clip projection 66 is first inserted in the clip attachment opening 70 and the snap projection 68 is then snapped into the snap attachment opening 72.

The user interface of the dimmer 40 comprises a slider control that is provided through the bezel opening 58 of the bezel 50. The user interface includes a slider knob 74, i.e., an operating knob, having a pushbutton 75 and a shaft 76 that extends through the bezel opening 58. The shaft 76 has a width substantially the same as the width of the bezel opening 58. The slider knob 74 has a width greater than the width of the bezel opening 58.

A thin elongated linearly movable operating member 78 of an electrical control component, e.g., a linear slider potentiometer (not shown), extends through a narrow slot 80 in a frame 82 (FIG. 10). The frame 82 is provided in an opening 84 of the yoke 44, which is disposed vertically along the center of the yoke. The slide potentiometer is preferably mounted to a printed circuit board (PCB) located inside the enclosure 42 of the dimmer 40. The operating member 78 of the potentiometer extends beyond a front surface of the yoke 44 and is vertically movable along the narrow slot 80 in the frame 82. The shaft 76 of the slider knob 74 is operatively coupled to the operating member 78 of the potentiometer. Accordingly, movement of the slider knob 74 along the length of the bezel opening 58 adjusts the resistance provided between the terminals of the slide potentiometer and thus the intensity of the connected lighting load. Actuation of the pushbutton 75 toggles the connected lighting load between on and off.

Figure 13:
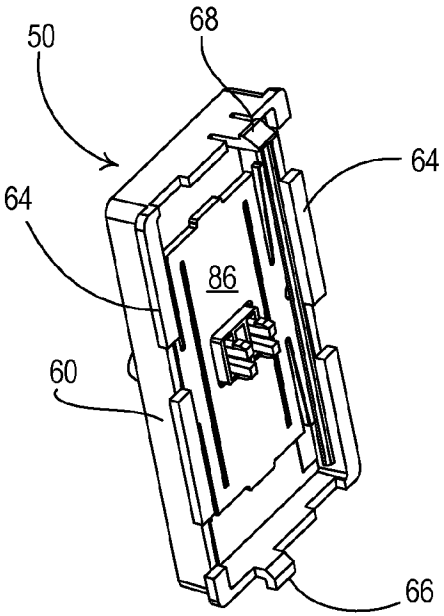
FIG. 13 is a perspective view of the faceplate assembly of FIG. 12, as seen from another angle.
Figure 12:
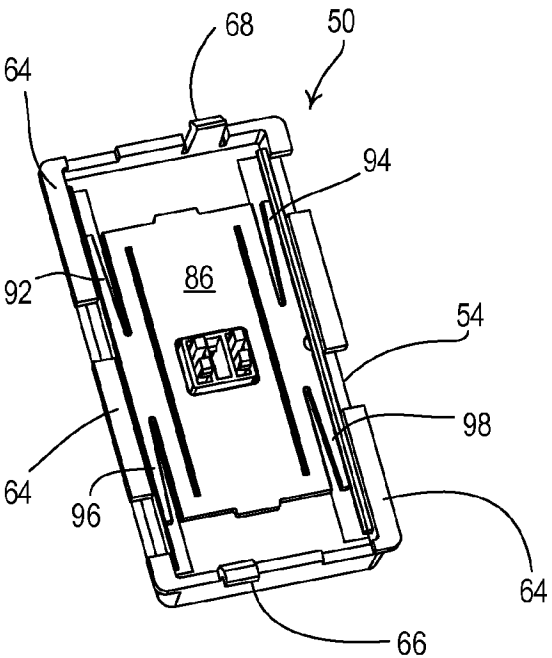
FIG. 12 is a perspective view of the faceplate assembly showing a bezel and a sliding cover plate slidably mounted within the bezel.

A generally flat sliding cover plate 86 is slidably positioned immediately behind the bezel opening 52 of the bezel 50 (FIGS. 12 and 13). The sliding cover plate 86 prevents debris and external objects from contacting the potentiometer inside the dimmer 40 as well as providing an attractive aesthetic. The shaft 76 extends through the sliding cover plate 86, such that the sliding cover plate moves as the slider knob 74 moves. The bezel 50 comprises support rails 88 on the left and right side walls 54 of the bezel 50. The support rails 88 support the sliding cover plate 86 as will be described in greater detail below.

The sliding cover plate 86 has a length that is greater than the length of the bezel opening 58. However, the slider knob 74 is operable to move the length of the bezel opening 58. The sliding cover plate 86 fully covers (i.e., masks) the bezel opening 58 as the slider knob 74 is moved over the full length of the bezel opening. Accordingly, the opening 84 of the yoke 44, and thus the slot 80 in the frame 82, are covered by said cover plate 86 in all vertical adjustment positions of the slider knob 74 along the length of the bezel opening 58.

The shaft 76 of the slider knob 74 extends through the bezel opening 58 and a cover plate opening 90 of the sliding cover plate 86 to engage the potentiometer shaft 78. The cover plate opening 90 has a length and a width substantially equal to the length and the width of the shaft 62 of the slider knob 74. The cover plate opening 90 in the sliding cover plate 86 receives the shaft 76, such that the slider knob 74 and the cover plate 86 move up and down together along a vertical axis of the dimmer 40.

The sliding cover plate 86 is captured within the interior of the shallow cup of the bezel 50 by the support rails 88 of the left and right side walls 60 (FIGS. 12 and 13). The sliding cover plate 86 is thus vertically slidable within the bezel 50. The sliding cover plate 86 has a plurality of integrally projecting flexible fingers 92, 94, 96, 98, which allow the sliding cover plate to rest on the support rails 88 and allow for vertical movement of the sliding cover plate. The flexible fingers 92, 94, 96, 98 engage the interior of the left and right side walls 60 of the bezel 50 to provide a sliding friction for the sliding cover plate 86.

During installation of the faceplate assembly (i.e., the bezel 50, the slider knob 74, and the cover plate 86) to the yoke 44 of the dimmer 40, the support rails 88 hold the cover plate to the bezel while the bezel is attached to the yoke. The slider knob 74 is then aligned with the opening 90 of the cover plate 86 and mounted on the operating member 78 of the potentiometer.

In a specific embodiment of the invention, the bezel 50 has a length along the vertical axis of about 2.6" and a width along the horizontal axis of about 1.3". The bezel opening 58 has a length of about 0.932" and a width of about 0.40". The sliding cover plate 86 has a length of about 1.5" and a width of about 1.2" (to fit snugly within the left and right side walls 60 of the bezel 50). The opening 90 of the sliding cover plate 86 has a length of about 0.32" and a width of about 0.39" to firmly receive the shaft 76 of the slider knob 74. However, the values provided for these dimensions are provided as examples of the preferred embodiment of the present invention and should not limit the scope of the present invention.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A wallbox dimmer for controlling the amount of power delivered from an AC power source to an electrical load, said dimmer comprising:

an enclosure adapted to fit into an opening of an electrical wallbox;

a yoke fixed to said enclosure and adapted to mount said dimmer to said electrical wallbox;

an electrical control component mounted within said enclosure and having a vertically-movable thin elongated operating member extending out of an opening of said yoke and beyond a front surface of said yoke;

a rectangular bezel having side walls defining a shallow cup and a front surface extending across one end of said cup, the opposite and open end of said cup being fixed to said front surface of said yoke, said front surface of said bezel having a rectangular opening in the center thereof;

an operating knob having a shaft extending through said rectangular opening in said bezel and fixed to the free end of said operating member, said operating knob operable to vertically move across the length of said rectangular opening; and a generally flat cover plate slidably positioned immediately behind said rectangular opening in said bezel and captured in the interior of said cup against said side walls of said bezel, said cover plate comprising an opening through which said shaft of said operating knob extends, such that said cover plate is vertically moveable with said operating knob, said cover plate fully covering said rectangular opening over the full length of the vertical movement of said operating knob, whereby said opening of said yoke is covered by said cover plate in all vertical positions of said operating knob;

further wherein said cover plate comprises a plurality of flexible fingers projecting into contact with said side walls of said bezel to hold said cover plate in position until moved by movement of said operating knob.

2. The dimmer of claim 1, wherein said bezel further comprises support rails provided in said side walls, said flexible fingers of said cover plate adapted to rest on said support rails, such that said cover plate is captured by said support rails within the interior of said cup of said bezel.

3. The dimmer of claim 1, wherein said bezel comprises a snap projection, and said yoke comprises a snap attachment opening for receiving said snap projection of said bezel, such that said bezel is fixed to said yoke.

4. The dimmer of claim 1, wherein said bezel comprises a clip projection, and said yoke comprises a clip attachment opening for receiving said clip projection of said bezel.

5. The dimmer of claim 1, wherein said bezel has a length and a width dimensioned such that said bezel is operable to be received with an opening of a designer-style faceplate, said bezel adapted to project through said opening of said faceplate.

6. The dimmer of claim 1, wherein said operating knob includes a pushbutton for toggling said electrical load on and off.

7. The dimmer of claim 1, wherein said operating knob has a width greater than the width of said rectangular opening in said bezel.

8. The dimmer of claim 1, wherein said opening of said yoke is disposed vertically along the center of said yoke.

9. The dimmer of claim 1, wherein said electrical control component comprises a slide potentiometer having a linearly-movable operating member coupled to said shaft of said operating knob.

10. The dimmer of claim 1, wherein said cover plate has a length which is greater than the length of said rectangular opening of said bezel.

11. A load control device comprising:

a bezel fixed to a front surface of said load control device and having a rectangular opening therein, said bezel defining side walls;

a flat cover plate disposed behind said bezel and slidably movable along a vertical axis with respect to said front surface of said load control device; and an operating knob having a shaft coupled to said cover plate and projecting through said opening of said bezel, said cover plate covering the rear of said opening in all positions to which said cover plate can be moved by said operating knob;

further wherein said cover plate comprises a plurality of flexible fingers projecting into contact with said side walls of said bezel to hold said cover plate in position until moved by movement of said operating knob.

12. The load control device of claim 11, wherein said bezel further comprises support rails provided in said side walls, said flexible fingers of said cover plate adapted to rest on said support rails, such that said cover plate is captured by said support rails within the interior of said cup of said bezel.

13. The load control device of claim 11, wherein said bezel comprises a snap projection, and said yoke comprises a snap attachment opening for receiving said snap projection of said bezel, such that said bezel is fixed to said yoke.

14. The load control device of claim 11, further comprising:

a slide potentiometer having a linearly-movable operating member coupled to said shaft of said operating knob.

15. A faceplate structure for a load control device, said faceplate structure comprising:

a bezel adapted to be fixed to said load control device, said bezel defining side walls and having an elongated rectangular opening extending along a vertical axis of said bezel;

an operating knob having a shaft extending through said elongated opening of said bezel and operable to vertically move along the length of said elongated opening; and a cover plate disposed behind said bezel and slidably coupled to said side walls of said bezel, said shaft of said operating knob coupled to said cover plate, such that said cover plate is vertically movable with respect to said bezel, said cover plate covering the rear of said opening in all positions to which said cover plate can be moved by said operating knob;

further wherein said cover plate comprises a plurality of flexible fingers projecting into contact with said side walls of said bezel to hold said cover plate in position until moved by movement of said operating knob.

16. The faceplate structure of claim 15, wherein said bezel further comprises support rails provided in said side walls, said flexible fingers of said cover plate adapted to rest on said support rails, such that said cover plate is captured by said support rails within said bezel.

* * * * *